US005563688A

United States Patent [19]

Bergen et al.

[11] Patent Number: 5,563,688

[45] Date of Patent: Oct. 8, 1996

[54] CHARGING DEVICE FOR CHARGING IN ONE OF A PLURALITY OF PREDEFINED IMAGE AREAS ON A SURFACE OF AN IMAGING MEMBER

[75] Inventors: Richard F. Bergen, Ontario; Robert W. Gundlach, Victor, both of N.Y.

[73] Assignee: Xerox Corporation, Stamford, Conn.

[21] Appl. No.: 355,565

[22] Filed: Dec. 14, 1994

[51] Int. Cl.[6] ..... G03G 15/02; H01T 19/04

[52] U.S. Cl. ..... 355/219; 250/324; 355/311; 361/225

[58] Field of Search ..... 355/219, 218, 355/222, 221, 311; 361/225, 229, 230, 235, 213, 214; 250/324–326

[56] References Cited

U.S. PATENT DOCUMENTS

| | | | |
|---|---|---|---|
| 2,588,699 | 3/1952 | Carlson | 355/219 X |
| 2,777,957 | 1/1957 | Walkup | 355/225 X |
| 3,944,356 | 3/1976 | Hayne | 355/225 X |
| 4,086,650 | 4/1978 | Davis et al. | 361/229 |
| 4,425,035 | 1/1984 | Tarumi et al. | 250/324 X |
| 4,562,447 | 12/1985 | Tarumi et al. | 250/326 X |
| 4,700,261 | 10/1987 | Nagase et al. | 361/225 |
| 4,839,695 | 6/1989 | Yamamoto et al. | 355/218 |
| 4,841,146 | 6/1989 | Gundlach et al. | 250/324 |
| 4,963,738 | 10/1990 | Gundlach et al. | 250/326 |
| 5,043,579 | 8/1991 | Gundlach et al. | 250/325 |
| 5,153,435 | 10/1992 | Greene | 250/326 |
| 5,245,502 | 9/1993 | Genovese | 361/225 |
| 5,257,045 | 10/1993 | Bergen et al. | 347/123 |

FOREIGN PATENT DOCUMENTS 63-146084 6/1988 Japan .

*Primary Examiner*—Shuk Yin Lee
*Attorney, Agent, or Firm*—Lloyd F. Beal, II

[57] ABSTRACT

A printing machine adapted to print an image on a plurality of different predefined sized sheets, including an imaging member adapted to receive the image on a plurality of predefined image areas on the surface of the imaging member. A selector is provided for selecting one of the plurality of different predefined sized sheets to be printed on. And, a corona generating device is provided for charging only one of the plurality of different predefined image areas associated with the one of the plurality of different predefined sized sheets selected.

18 Claims, 6 Drawing Sheets

CHARGING DEVICE FOR CHARGING IN ONE OF A PLURALITY OF PREDEFINED IMAGE AREAS ON A SURFACE OF AN IMAGING MEMBER

The present invention relates generally to an electrostatographic printing machine and, more particularly, concerns a corona generating device.

INCORPORATION BY REFERENCE

The following United States patents are specifically incorporated by reference for their background teachings, and specific teachings of the principles of operation, construction and use of charging for applying a surface charge to the charge retentive surfaces of electrophotographic devices: Co-pending U.S. Ser. No. 08/355,577 filed concurrently herewith, U.S. Pat. Nos. 2,588,699; 2,777,957; 4,086,650; 4,425,035; 4,562,447; 4,841,146; 4,963,738; 5,257,045 and 5,153,435.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member. The photosensitive surface thereof can contain more than one image at one time as it moves through various processing stations. The portions of the photosensitive surface containing the projected images, so-called "image areas" or "pitches" and are usually separated by a segment of the photosensitive surface called an interdocument space. Image areas have different sizes depending on the size of copy sheet selected (i.e. 8½ by 11, 8½ by 14). For example, when 8½ by 11 copy sheets are selected to be copied on an image area on the photosensitive surface which would correspond to the largest sheet, would be charged, however only the 8½ by 11 image area would be selectively exposed while the remaining portions of the image area associated with largest sheet, would remain fully charged. It has been found that the remaining portions of the image area of the largest sheet which remain fully charged cause several undesirable problems: 1) toner particles are attracted to the photoconductive surface which lead to copy quality defects; 2) unnecessary stress on the photosensitive surface which reduces life of the photoconductive member.

A simple, relatively inexpensive, and accurate approach to eliminate the above mentioned problems, in such printing systems, has been a goal in the design, manufacture and use of electrophotographic printers. The need to provide accurate and inexpensive charging systems has become more acute, as the demand for high quality, relatively inexpensive electrophotographic printers has increased.

Various techniques for charging have hereinbefore been devised as illustrated by the following disclosures, which may be relevant to certain aspects of the present invention:

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charges to the receiver more efficiently, but compromises the control function of the device.

Other methods exist for trying to obtain uniform charging from negative charging systems, such as dicorotron charging devices as shown in U.S. Pat. No. 4,086,650 that include glass coated wires and large specialized AC power supplies. Devices for modulating ions include U.S. Pat. Nos. 4,425,035 and 4,562,447 which disclose an ion modulating electrode for an electrostatic recording apparatus. The ion modulating electrode includes a continuous layer of conductive material and a segmented layer of conductive material separated from each other by an insulating layer. The insulating layer includes a plurality of apertures, which may be bored by a laser beam, through which the ions flow. U.S. Pat. No. 2,932,742 discloses an apparatus for charging a xerographic plate and has a screen electrode consisting of alternating conductive areas having open spaces therebetween. U.S. Pat. No. 4,841,146 is directed to a self cleaning charging unit that includes an insulating housing and a current limited, low capacitance corona wire positioned within the housing and located 0.5–6 mm away from biased conductive plates which form a slit through the bottom of the housing that allows ions to pass therethrough onto a receptor surface. These devices have not been entirely satisfactory since some of these are costly, while others are difficult to fabricate and most are inefficient.

A scorotron charging device that meets some of the above deficiencies is U.S. Pat. No. 4,963,738 which is directed to a charging device having a coronode that includes a comb-like ruthenium glass electrode silk screened onto a supporting dielectric substrate. The teeth of the comb-like electrode extend to an edge of the dielectric substrate and positionable relative to a screen or slit in order to form a scorotron. But, the problem with this unit is that it requires three structures (a corotron generator, insulator and counter electrode) to be carefully aligned in a support frame.

Present slit type scorotrons require precise alignment of at least three parts in a support frame. For example, the charging unit in U.S. Pat. No. 4,963,738 requires exact alignment of the charging elements, the insulator element and the reference electrode. An electrode cooperates with and is positioned adjacent to reference electrode in order to form a slit through which ions are emitted. The device includes a flat scorotron positioned in a horizontal plane above a charge retentive surface supported on a grounded conductor and a high voltage supply is connected to buss bar which in turn, is connected to a comb-like member having coronode lines 14. Electrodes and reference electrodes are used for potential leveling.

U.S. Patent No. 5,153,435 discloses a charging device in which the need for precise alignment of parts is eliminated. The rigid, one-piece, slotted scorotron comprises a substrate of a thin planar piece of alumina with a ruthenium comb-like pattern on one side, and a solid conductor on the opposite side. Alumina substrate has machined, staggered slots, e.g., formed by the use of lasers, therein that form a series of slits that allow ion flow. Each slot serves the function of the slit in U.S. Pat. No. 4,963,738, i.e., the terminated ruthenium tips of fingers are the corona source, and the solid metal electrode provides the pumping fringe fields and the reference potential. All of the above-mentioned references are incorporated herein by reference.

Accordingly, there is provided a printing machine adapted to print an image on a plurality of different predefined sized sheets, including an imaging member adapted to record the image in one of a plurality of predefined image areas on the surface of the imaging member with each of the plurality of different predefined image areas corresponding to one of the plurality of different predefined sized sheets. Means are provided for selecting one of the plurality of different predefined sized sheets to be printed on. A corona generating device is provided for charging only one of the plurality of different predefined image areas corresponding to the one of the plurality of different predefined sized sheets selected.

There also is provided a charging device adapted to charge in one of a plurality of predefined image areas on the surface of an imaging member, including a dielectric layer with a corona producing element formed on a first surface of a dielectric layer and a reference electrode, positioned on a second surface of the dielectric layer, opposed from the first surface having the corona producing element formed thereon. A DC voltage source is coupled to the reference electrode. An AC voltage source is coupled to the corona producing element for energizing the reference electrode element to emit ions therefrom.

The foregoing and other features of the instant invention will be more apparent from a further reading of the specifications, claims and from the drawing in which:

While the present invention is described hereinafter with respect to a preferred embodiment, it will be understood that this detailed description is not intended to limit the scope of the invention to that embodiment. On the contrary, the description is intended to include all alternatives, modifications and equivalents as may be considered within the spirit and scope of the invention as defined by the appended claims.

Figure 8:
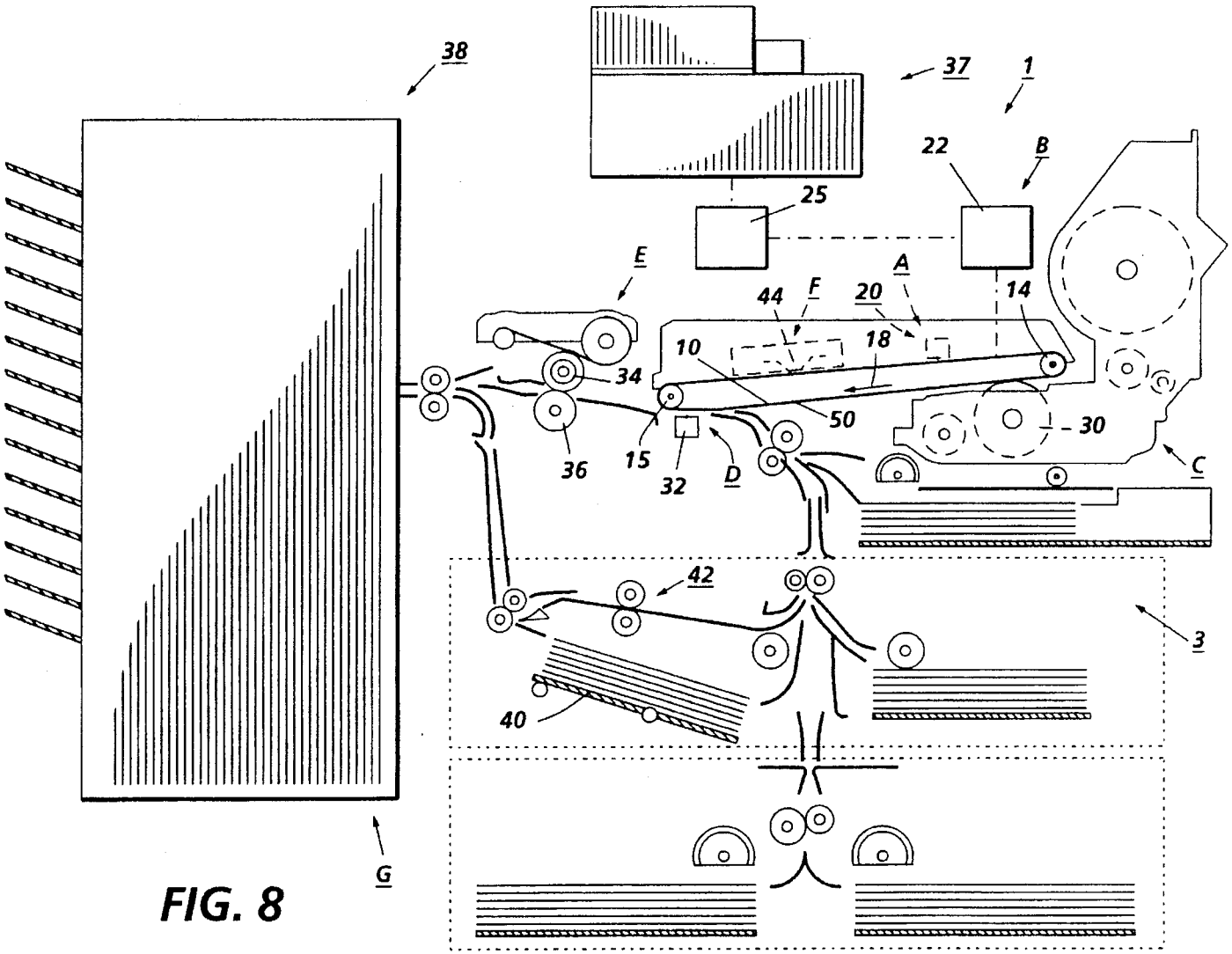
FIG. 8 is a schematic, elevational view depicting an illustrative electrophotographic printing machine incorporating the corona generating device of the present invention.

For a general understanding of the features of the present invention, reference is made to the drawings wherein like references have been used throughout to designate identical elements. A schematic elevational view showing an exemplary electrophotographic printing machine incorporating the features of the present invention therein is shown in FIG. 8. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

FIG. 8 schematically depicts an illustrative electrophotographic printing machine, such as disclosed in U.S. Pat. No. 5,258,817 in which the contents of which are incorporated by reference herein. While a specific printing machine is shown and described, the present invention may be used with other types of printing systems. Specifically, the printing machine 1 of FIG. 8 has both a copy sheet transport system 3 for transporting sheets of material such as paper, mylar and the like, to and from processing stations of the machine 1. The machine 1, has conventional imaging processing stations associated therewith, including a charging station A, an imaging/exposing station B, a development station C, a transfer station D, a fusing station E, a cleaning station F and a finishing station G. The machine 1 has a photoconductive belt 10 with a photoconductive layer 50. The belt 10 is entrained about a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

A document is scanned by compact scanner 37 with array. The array provides image signals or pixels representative of the image scanned which after suitable processing by processor 25, are output to light source 22. Processor 25 converts the analog image signals output by the array to digital and processes the image signals as required to enable machine 1 to store and handle the image data in the form required to carry out the job programmed. Processor 25 also provides enhancements and changes to the image signals such as filtering, thresholding, screening, cropping, reduction/enlarging, editing, etc.

The photoconductive belt 10 is charged at the charging station A by a corona generating device 20 of the present invention. The charged portion of the belt is then transported by action the drive roller 14 to the imaging/exposing station B where a latent image is formed on the belt 10 by light source 22. In this case, it is preferred that the light source is a raster output scanning device (a ROS) which is driven in response to signals from processor 25.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet transport system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray (not shown) through a finishing device 38 or along a selectable duplex path including apparatus for buffered duplexing and for immediate duplexing (i.e., tray 40 and path 42 in the case of the illustrative printing machine of FIG. 8). The portion of the belt 10 which bore the developed image is then transported to the cleaning station F where residual toner and charge on the belt is removed in a conventional manner by a blade edge 44 and a discharge lamp (not shown). The cycle is then repeated.

The foregoing description should be sufficient to illustrate the general operation of an electrophotographic printing machine.

Figure 1:
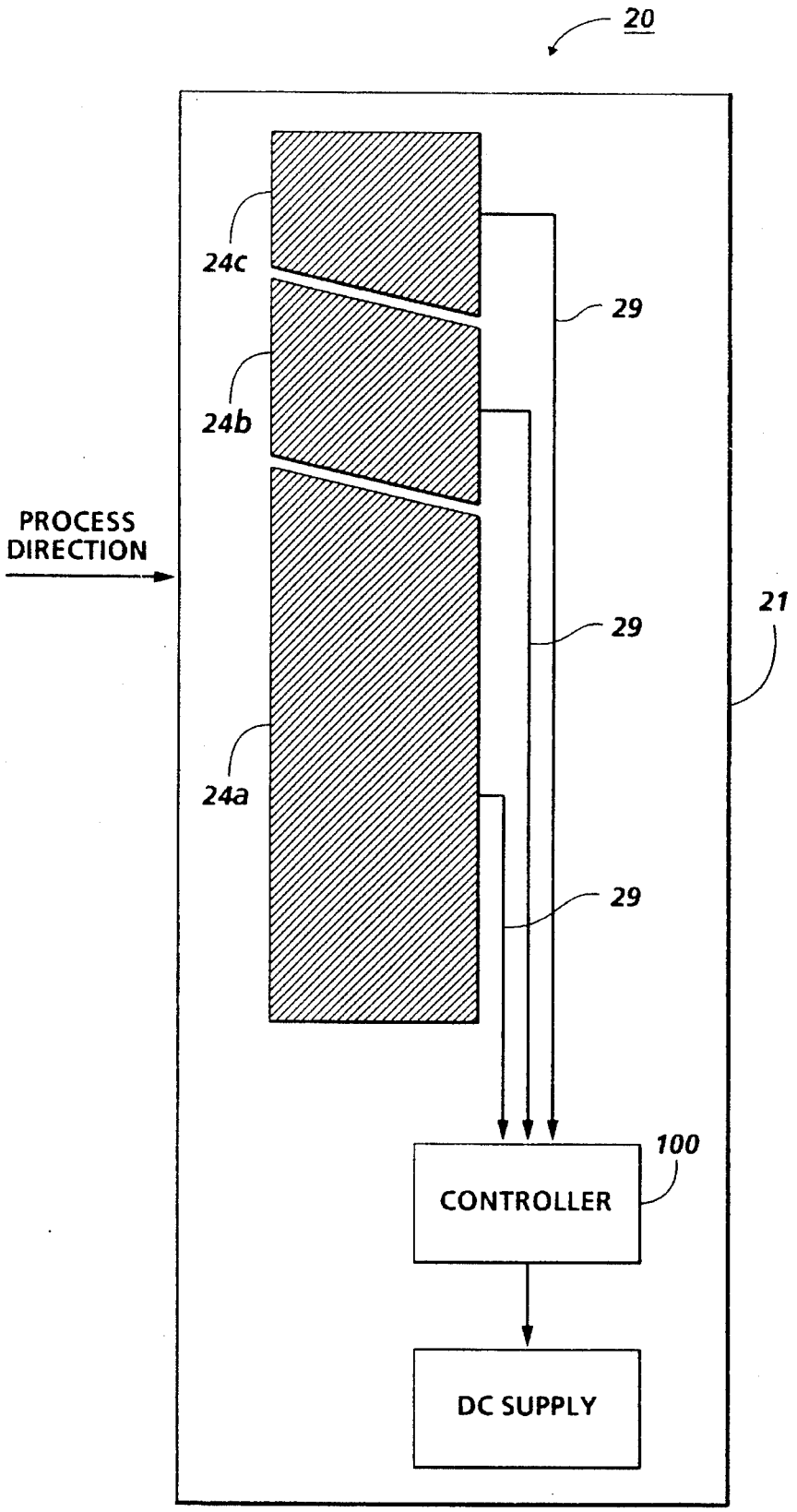
FIGS. 1 and 2 are plain views of an embodiment of the corona generating device of the present invention.
Figure 2:
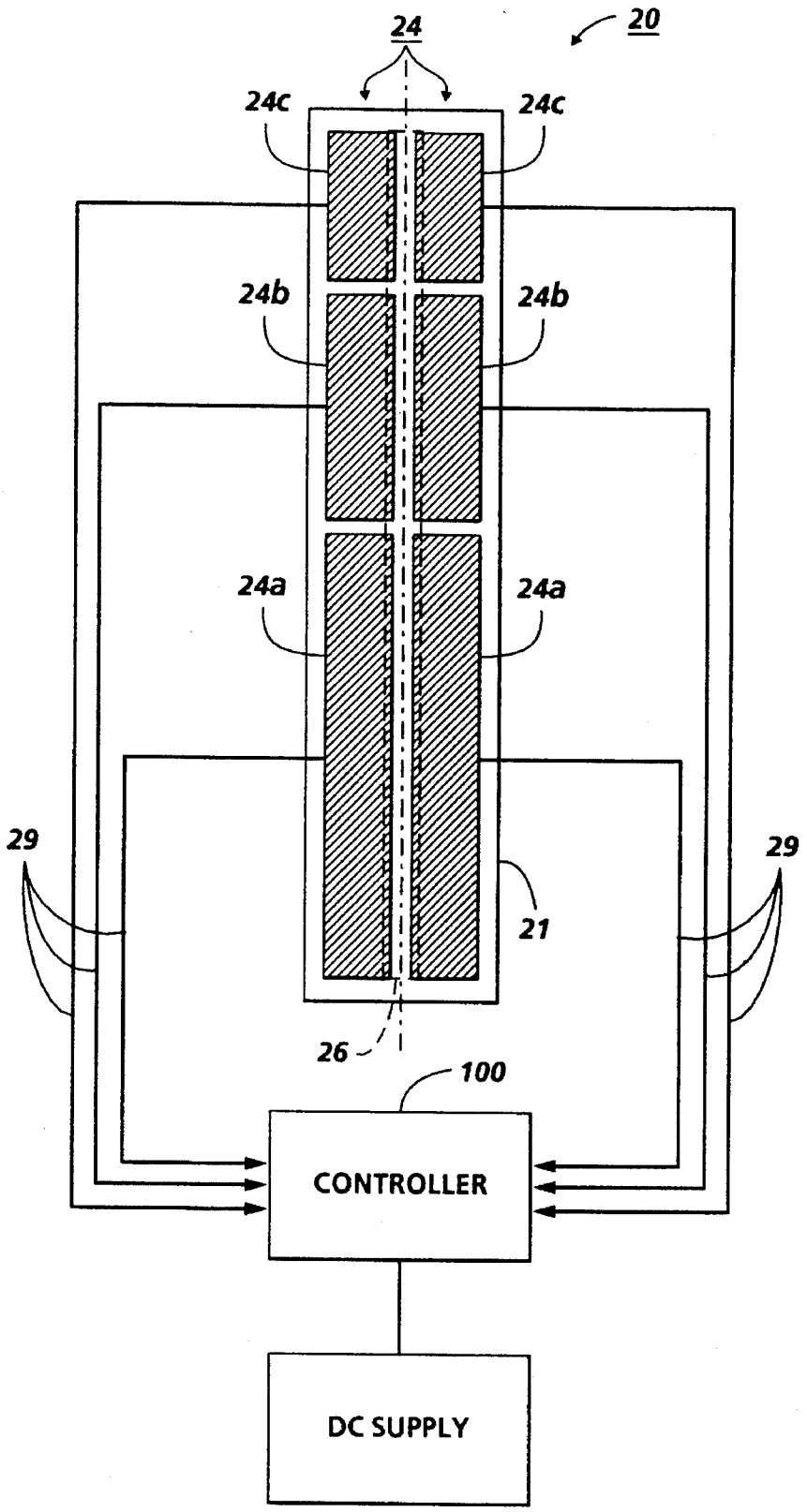
Figure 3:
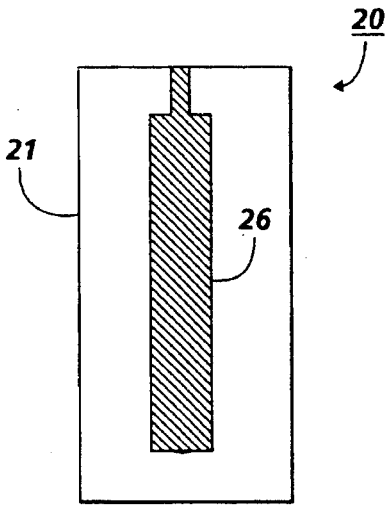
FIG. 3 is a plain view of the corona generating device of FIG. 1.

With reference to FIGS. 1–4 corona generating device 20 includes a low DC voltage, e.g. 1000 V, at 29 which is electrically connected to an upper electrode(s) 24. A high AC voltage, e.g., 4 kVp-p at 15 kHz, is electrically connected to a lower electrode 26. Both electrode 24 and 26 comprise suitable conductive materials such as copper or palladium silver in a ceramic or glass binder, all of which are supported on the top and bottom surfaces of an alumina support 21. Alumina support 21 separates the upper and lower electrodes 24 and 26 with its preferable thickness of about 0.5 mm (0.020"), however, the thickness can range from about 0.001 to about 0.100". Preferably, lower electrode 26 has a conductive solid region with the same length, shape, width and in registration with the upper electrode. Lower electrode 26 has a thickness of about 0.5 mm (0.025"), however, the thickness can range from about 0.001" to about 0.010" inches. Upper electrode 24 has a thickness of about 0.001", however, the thickness can range from about 0.0001" to about 0.005". Upper electrode 24 has a pattern on the top surface of insulator support 21. The pattern is segmented and each segment is individually addressable so that low DC voltage can be applied to pump ions to the imaging member, or not applied to inhibit ions moving to the imaging member. The length of the segments correspond to different copy paper sizes. Segments are actuated (i.e. voltage applied) by controller 100 in accordance to the size of copy sheet selected, thereby the image area on the photoconductor corresponding to the copy sheet selected is only charged. The pattern can be a slit like pattern (as shown in FIG. 2); or a grid-like pattern ( as shown in FIG. 1). For example, if a 8½ by 11 sheet was selected upper electrode segment **24*a* would be actuated; if a 8½ by 14 sheet was selected upper electrode segments 24*a* and 24*b*** would be actuated.

In operation of the present invention, the AC lower electrode on one side of a substrate generates corona within the screen apertures on the upper electrode. DC potential applied to the upper electrode, such as a screen, provides the charge driving and leveling forces. Referring to FIG. 4C corona is produced on the edges of the pattern. For example, a screen pattern produces corona in the apertures of the screen, at the edges, and the field due to the voltage on the screen drives the ions to the imaging receptor.

If desired, controller 100 can selectively actuate a multiplicity of desired segments in response to the velocity of the photosensitive surface so that the image areas can be defined in both length and width direction, thereby the inter-document space segments of the photosensitive surface are not charged.

It should be evident that the present invention could be also employed in a transfer station to only charge the back portion of the copy sheet selected. It should be evident that the segments can be selectively actuated so that different areas on the imaging receptor can be charged to different potential levels, for example segments could be positioned so that edges of an image area could be charged to a higher potential.

Figure 5:
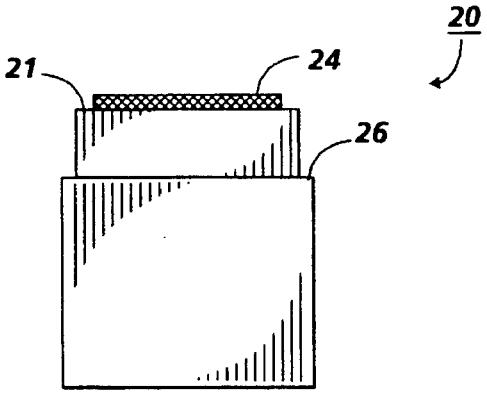
FIG. 5 is an elevational view of a second embodiment of the corona generating device of the present invention.

In a second embodiment of the present invention, as shown in FIG. 5, lower electrode comprises a conductive substrate 26, such as any metal, having an insulating layer 21 of dielectric material, preferably alumina, and coated on the top surface with STAT, reference electrode 24. Upper electrode 24 comprises a conductive layer coated onto insulating layer 21, such as a conductive ink, or palladuim/silver ceramic material; insulating layer 21 has a thickness of about 0.5 mm (0.020"), however, the thickness can range from about 0.005" to about 0.100". Preferably, conductive substrate 26 has a thickness of about 2 mm (0.08"), however, the thickness can range from about 0.010 to about 0.5 inches; upper electrode 24 has a thickness of about 0.002 inches, however, the thickness can range from about 0.001" to about 0.010".

Figure 6:
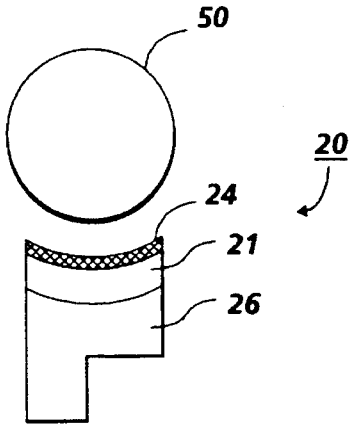
FIG. 6 is an elevational view of a third embodiment of the corona generating device of the present invention.

An advantage of the second embodiment is that a substrate can be readily fashioned to match the curvature of the receptor, as shown in FIG. 6. This enables more flexibility in the placement of the charging device and also provides a substrate which is less prone to breaking as compared to prior art ceramic substrate devices. Also, there curvature of the screen matching the curvature of the receptor allows efficiently charging uniformly along and around the curved surface.

Figure 4A:
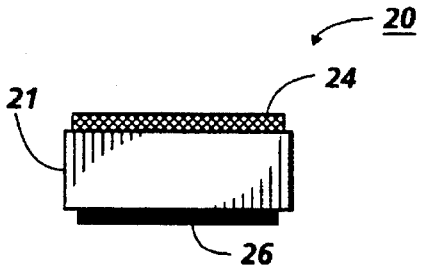
FIG. 4A is an elevational view of the corona generating device of FIG. 1 or 2.
Figure 4B:
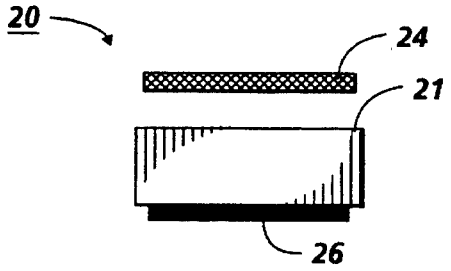
FIG. 4B is an elevational view of the corona generating device with the upper electrode being spaced from the supporting substrate.
Figure 4C:
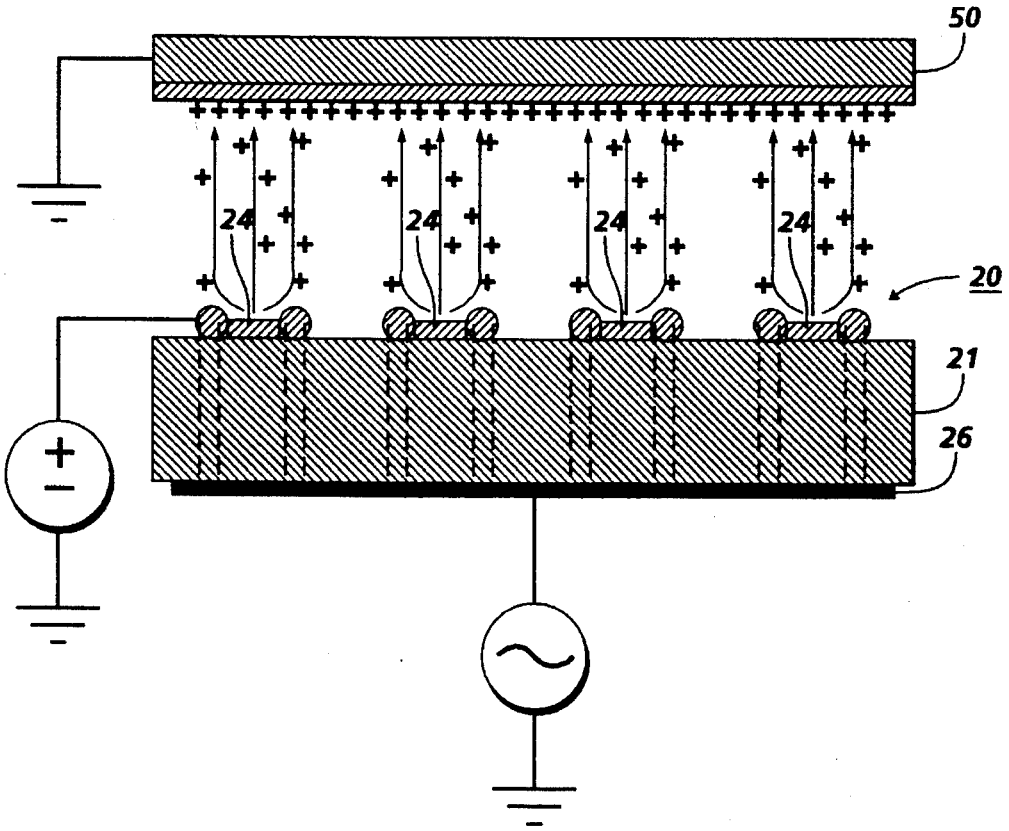
FIG. 4C is an enlarged sectional elevational of the corona generating device of FIG. 1.

In a third embodiment of the present invention, as shown in FIG. 4B, lower electrode comprises a conductive electrode 26, having an insulating substrate 21 of alumina. Upper electrode 24 is spaced from conductive substrate 26. Upper electrode 24 comprises a rigid conductive screen 40. Preferably, upper electrode 24 is spaced about 12 mils from insulating layer 21 and about 20 mils from the charge receptor however, the spacing from the insulating layer can range from about 0.1 mm to about 2 mm and the spacing from the charge receptor can range from about 0.1 mm to about 2 mm.

Another advantageous feature of the present invention is that the charging and/or transfer characteristics can be selected to meet charging and/or transfer requirements by selecting the appropriate width of the upper and lower electrodes, for example the corona generated and available for charging is linearly related to the width as measured in the process direction, of the charging zone A. A 1 mm wide screen generates 6 times less charges than a 6 mm wide screen.

Figure 7:
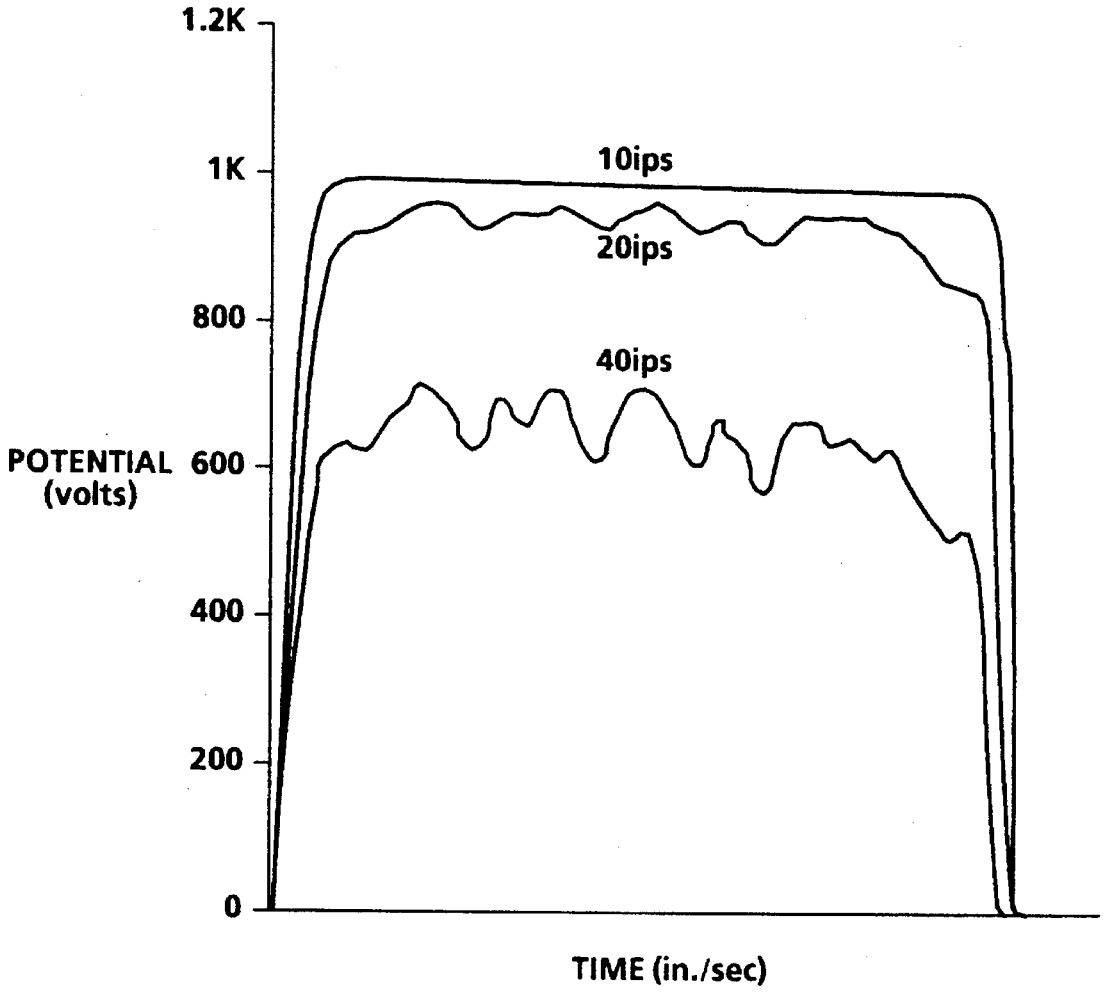
FIG. 7 is a graph showing experimental data of a charging device in accordance of the present invention.

In operation for optimum performance, the present invention is placed in propinquity in relation to the charge receptor between from about 0.005" to about 0.25" from the charge receptor. The present invention offers improved surface charge uniformity as compared to prior art devices. A charging device in accordance of the present invention was tested to charge a 1 mil thick Mylar® imaging member with a spacing of 20 mils between the charging device and the imaging member. The device had an upper electrode which was a screen pattern with a percent open of 25%, composed of 1 mil thick copper in a ceramic binder; lower electrode was composed of 1 mil thick copper in a ceramic binder. The support substrate was a 10 mil thick Alumina. A 1000 volts D.C was applied to the upper electrode and 3.9 KVpp@50 KHz was applied to the lower electrode. Referring to FIG. 7, It was found that at 10 inches per sec (ips) that the mylar charge up to 1000 volts in a very uniform manner and also the charging device had useful charging characteristic @20 ips and 40 ips.

It has also been contemplated that the segment screen or slit of the present invention could be employed in a scorotron charging device such as U.S. Pat. No. 4,963,738 which is directed to a charging device having a coronode that includes a comb-like ruthenium glass electrode silk screened onto a supporting dielectric substrate. The teeth of the comb-like electrode extend to an edge of the dielectric substrate and positionable relative to a screen or slit in order to form a scorotron. Also, a wire coronode could also be employed with a segment screen or slit of the present invention.

Moreover, It has been contemplated that a FIST charging device such as U.S. Pat. No. 5,257,045 can be modified to meet some of the objects of the present invention by addressing segments of holes which correspond to different copy paper sizes.

While this invention has been described with reference to the structure disclosed herein, they are not confined to the details set forth and are intended to cover modifications and changes that may come within the spirit of the invention and scope of the claims.

What is claimed is:

1. A printing machine for printing an image on a plurality of different predefined sized sheets, comprising:

an imaging member having an imageable surface means for recording the image in one of a plurality of predefined image areas on the surface of said imaging member with each of the plurality of different predefined image areas corresponding to one of a plurality of different predefined sized sheets;

means for selecting one of the plurality of different predefined sized sheets to be printed on; and a charging device for charging one of said plurality of different predefined image areas corresponding to the one of the plurality of different predefined sized sheets selected, said charging device having a ion emitting surface with a plurality of segment patterns on the surface thereof and wherein said plurality of segment patterns corresponds to each of said plurality of different predefined image areas.

2. The printing machine of claim 1, wherein said charging device comprises:

a dielectric layer;

a corona producing element formed on a first surface of said dielectric layer;

a reference electrode, positioned on a second surface of said dielectric layer, opposed from the first surface having said corona producing element formed thereon for controlling charging by said corona producing element;

a DC voltage source coupled to said reference electrode; and an AC voltage source coupled to said corona producing element for energizing said reference electrode element to emit ions therefrom.

3. The printing machine of claim 2, wherein said dielectric layer comprises a dielectric support substrate for supporting said corona producing element.

4. The printing machine of claim 2, wherein said corona producing element comprises a conductive substrate for supporting said dielectric layer.

5. The printing machine of claim 3, wherein said corona producing element comprises a conductive layer deposited on said dielectric support substrate.

6. The printing machine of claim 3, wherein said support substrate is made of alumina.

7. The printing machine of claim 3 wherein:

said DC voltage source is integrated onto said dielectric support substrate; and said AC voltage source is integrated onto said dielectric support substrate.

8. A printing machine for printing an image on a plurality of different predefined sized sheets, comprising:

an imaging member having an imageable surface;

means for recording the image in one of a plurality of predefined image areas on the surface of said imaging member with each of the plurality of different predefined image areas corresponding to one of a plurality of different predefined sized sheets;

means for selecting one of the plurality of different predefined sized sheets to be printed on; and a charging device for charging one of said plurality of different predefined image areas corresponding to the one of the plurality of different predefined sized sheets selected, said charging device including a dielectric layer, a corona producing element formed on a first surface of said dielectric layer, a reference electrode, positioned on a second surface of said dielectric layer, opposed from the first surface having said corona producing element formed thereon for controlling charging by said corona producing element, said reference electrode comprises a plurality of segment patterns, a DC voltage source coupled to said reference electrode; and an AC voltage Source coupled to said corona producing element.

9. The printing machine of claim 8, wherein said plurality of segment patterns define a plurality of apertures therein.

10. The printing machine of claim 8, wherein said plurality of segment patterns define a slit therein.

11. A charging device for charging in one of a plurality of predefined image areas on a surface of an imaging member comprising:

a dielectric layer;

a corona producing element formed on a first surface of said dielectric layer;

a reference electrode, positioned on a second surface of said dielectric layer, opposed from the first surface having said corona producing element formed thereon for controlling charging by said corona producing element, said reference electrode comprises a plurality of segment patterns;

a DC voltage source coupled to said reference electrode; and an AC voltage source coupled to said corona producing element.

12. The printing machine of claim 11, wherein said dielectric layer comprises a dielectric support substrate for supporting said corona producing element.

13. The printing machine of claim 11, wherein said corona producing element comprises a conductive substrate for supporting said dielectric layer.

14. The printing machine of claim 11, wherein said plurality of segment patterns define a plurality of apertures therein.

15. The printing machine of claim 12, wherein said corona producing element comprises a conductive layer deposited on said dielectric support substrate.

16. The printing machine of claim 12, wherein said support substrate is made of alumina.

17. The printing machine of claim 12, wherein:

said DC voltage source is integrated onto said dielectric support substrate; and said AC voltage source is integrated into said dielectric support substrate.

18. The printing machine of claim 11, wherein said plurality of segment patterns define a slit therein.

* * * * *